United States Patent [19]

Foster et al.

[11] Patent Number: 4,982,951

[45] Date of Patent: Jan. 8, 1991

[54] ENCOURAGING MOVEMENT

[76] Inventors: Elyena Foster, 25 Marion St., #PHI, Brookline, Mass. 02146-4904; Yuly Pulyer, 93 Ridge Rd., Revere, Mass. 02151

[21] Appl. No.: 29,990

[22] Filed: Mar. 25, 1987

[51] Int. Cl.[5] ..... A63B 69/00; G09B 19/00

[52] U.S. Cl. ..... 272/70; 434/247; 434/255; 434/258; 446/409

[58] Field of Search ..... 272/70, 70.2, 70.3, 272/73, DIG. 5, DIG. 6; 340/62; 116/57; 446/409, 411; 434/247, 255, 258

[56] References Cited

U.S. PATENT DOCUMENTS

| | | | |
|---|---|---|---|
| 3,266,455 | 4/1965 | Cohn | 446/409 X |
| 3,419,732 | 12/1968 | Lane | 272/73 X |
| 3,583,392 | 6/1971 | Frieberger et al. | 272/73 X |
| 3,765,245 | 10/1973 | Hampl | 272/73 X |
| 4,298,893 | 11/1981 | Holmes | 272/73 X |
| 4,408,613 | 10/1983 | Relyea | 272/DIG. 6 X |
| 4,542,897 | 9/1985 | Melton et al. | 272/73 |
| 4,580,983 | 4/1986 | Cassini et al. | 272/73 X |

FOREIGN PATENT DOCUMENTS

| | | | |
|---|---|---|---|
| 2949630 | 7/1980 | Fed. Rep. of Germany | 272/DIG. 5 |

*Primary Examiner*—Richard J. Apley
*Assistant Examiner*—David F. Crosby
*Attorney, Agent, or Firm*—Fish & Richardson

[57] ABSTRACT

A walker having wheels rotatably supported for orientation in any direction includes a flexible shaft for coupling rotation of the wheel to a tachogenerator in a supporting column that also carries an electronics cabinet including a relay that turns a tape recorder therein on when the wheel rotates, and off when the wheel is stationary. The electronics cabinet also includes a loudspeaker that reproduces the audible messages recorded on the tape recorder when the tape recorder is turned on.

4 Claims, 2 Drawing Sheets

ENCOURAGING MOVEMENT

The present invention relates in general to encouraging movement and more particularly concerns novel apparatus and techniques for encouraging people to make a movement, such as take a step, encouraged by the expectation of hearing encouraging talk or desired sounds provided by a recording or other source of stored sound.

It is often desired to encourage children, the aged or the infirm to walk. Often these people have walkers to assist them in walking.

A search of the prior art in subclass 245 of class 177, subclasses 176F and 199 of class 273 and subclasses 236, 238, 247, 255, 319 and 321 of class 434 uncovered U. S. Pat. Nos. 2,840,213, 3,575,559, 3,747,233, 4,212,116, 4,423,792, 4,576,244, 4,577,710 and an article on page 14 of RADIO-ELECTRONICS for December 1971 describing audio ball kits consisting of a regulation softball with a shockproof signaling unit embedded inside it that emits high-pitched beeps, enabling blind children to find it.

U.S. Pat. No. 3,575,559 discloses a system for use on a miniature golf course. When the golfer drives the golf ball on a course through a central channel aligned with the hole, the ball actuates a switch that causes a tape recorder to broadcast a recorded complementary message. If the golfer drives the ball to the side of the central channel, the ball actuates a switch that causes the tape recorder to play a recorded humorous critical message.

U.S. Pat. No. 3,747,233 discloses a system which helps teach the handicapped to walk by producing a sound each time the person being trained places a foot on a foot outline.

U.S. Pat. Nos. 4,576,244, 4,577,710 and 4,423,792 disclose personal scales that announce words of encouragement and admonishment when on a weight control program in response to the weight of the person on the scale and information related to the progress of the person in a weight control program.

It is an important object of the invention to provide improved apparatus for encouraging movement.

According to the invention, there is vehicle means for supporting a person and assisting said person in walking, such as a wheeled walker, wheeled toy, or other vehicle, said vehicle means having push bar means for engagement by said person for receiving a force from said person causing movement of said vehicle means and also having a source of a stored audible message encouraging said person hearing the message to walk and move the vehicle means, and means responsive to movement of the vehicle means for activating the sound source to provide an audible message to the person supported by and moving the wheeled vehicle to encourage the person to move the wheeled vehicle. Preferably the source of the stored audible message is a tape recorder, and there is means responsive to vehicle movement for providing an electrical movement signal for actuating a relay that turns the tape recorder on for a predetermined time interval. There is transducing means for reproducing the stored audible message, and means responsive to the movement signal for providing the stored audible message to the transducing means only while the vehicle means is moving.

Numerous other features, objects and advantages of the invention will become apparent from the following specification when read in connection with the accompanying drawing in which.

Figure 1:
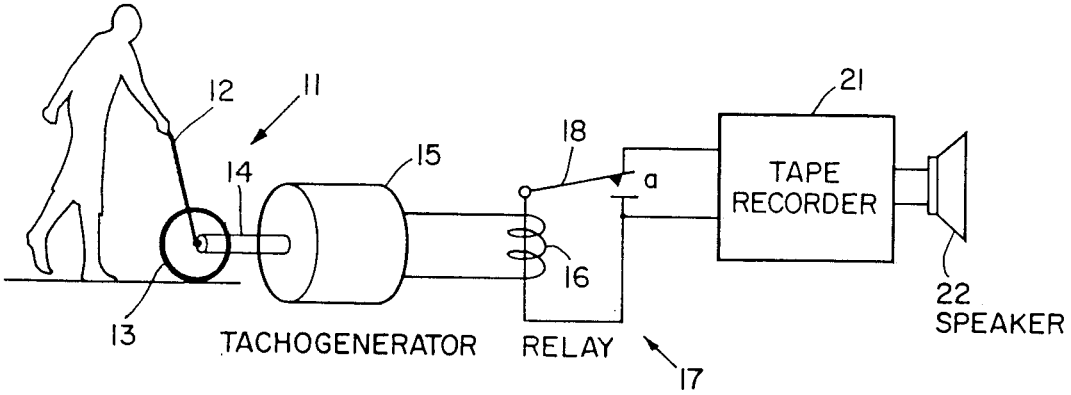
FIG. 1 is a combined block-pictorial-schematic diagram illustrating the logical arrangement of a system according to the invention.

With reference now to the drawing and more particularly FIG. 1 thereof, there is shown a combined block-pictorial-schematic representation of an embodiment of the invention. The system includes a vehicle 11 having a push bar 12 and at least one wheel 13 connected to the shaft 14 of a tachogenerator 15 that delivers a current to the coil 16 of relay 17 to operate relay arm 18 and turn tape recorder 21 on to produce audible sounds through loudspeaker 22 perceived by person 23 to encourage person 23 to keep pushing on push rod 12 to keep tape recorder on.

Figure 2:
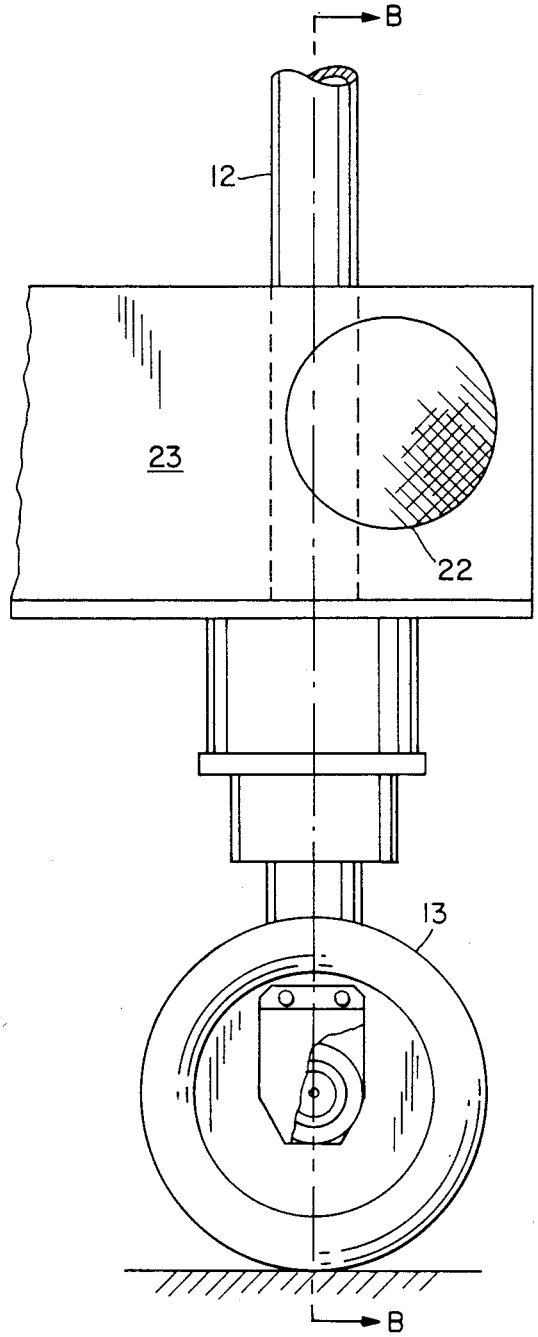
FIG. 2 is a fragmentary elevation view of structure according to the invention.

Referring to FIG. 2, there is shown a fragmentary elevation view of structure according to the invention. Wheel 13 is preferably supported so as to move in any direction below electronics cabinet 23 which includes relay 17, tape recorder 21 and speaker 22.

Figure 3:
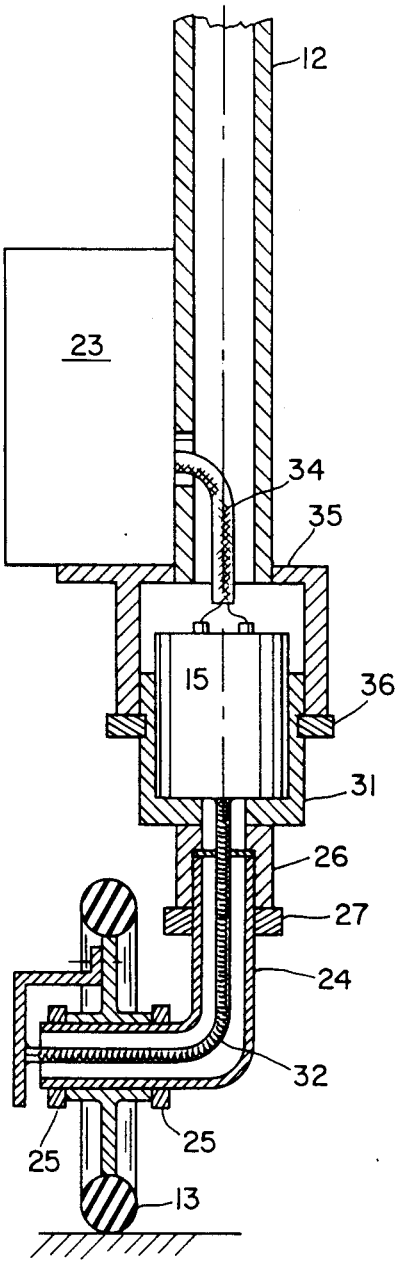
FIG. 3 is a view through section 3—3 of FIG. 2.

Referring to FIG. 3, there is shown a view through section 3—3 of FIG. 2 helpful in understanding the physical relationship among different components. Wheel 13 is mounted upon the end of L-shaped rotating wheel support tube 24 with the hub of wheel 13 mounted between limiting rings 25. Rotating wheel support tube 24 is free to rotate in stationary wheel tube 26 inside end support ring 27.

A cylindrical portion 31 support tachogenerator 15. A flexible cable 32 connects the axle of wheel 13 to the shaft of tachogenerator 15. Cable 34 couples electrical energy from tachogenerator 15 to relay coil 16 in electronics cabinet 23. Push bar 11 terminates in a semicylindrical chamber 35 that coacts with cylindrical chamber 31 to enclose tachogenerator 15. Limiting ring 36 secures the lower end of chamber 35 to cylindrical chamber 31.

When part of a conventional walker there may be one or two other wheel assemblies; however, only one need include the tachogenerator and electronics.

Having described the structural arrangement of the invention, its mode of operation will be described. When person 23 pushes push bar 12, wheel 13 rotates to cause tacogenerator 15 to energize relay coil 16 and operate arm 18 to turn tape recorder 21 on. As long as person 23 keeps wheel 13 moving, tape recorder 21 remains on, sending encouraging audible messages through speaker 22 to person 23.

An important purpose of the invention is to stimulate the movement of a baby walker, toy vehicle or therapeutic walker by producing audible sounds which are encouraging, rewarding, amusing or entertaining to the person pushing. Since sound begins with movement and ends with movement stopping, the person pushing will quickly learn the association and have the desire to maintain the movement and produce the desired audible sound.

The invention has a number of applications. Babies learning to walk may be placed in walkers which are free to move in any direction as the baby rises from a sitting to a standing position. The invention will stimulate the baby to push the walker when the motion is rewarded by strong rhythmic or melodic music, or by a recording of a parent's voice delivering an encouraging message. Older babies may be placed in self-propelled toy vehicles, carts, tricycles or other vehicles and receive similar encouragement to move and exercise. The reproduced audible sounds may be amusing or entertaining, such as the noise of an automobile engine and horn, or other sounds of motion.

Physically handicapped or mentally retarded persons may also receive incentive to learn and practice walking when they are rewarded by the pleasing and encouraging sounds which they produce by moving the walker.

The invention may thus be used to develop walking ability in young babies, to promote physical health as the child grows by encouraging the use of self-propelled toy vehicles, and to provide encouragement for the use of therapeutic walking devices by the physically handicapped or mentally retarded.

The invention achieves advantageous results by providing audible sounds which gratify, encourage, amuse, entertain, or have rhythmic or musical appeal to the person moving the vehicle that causes sound to be produced.

The specific apparatus and techniques described herein are by way of example only. It is evident that those skilled in the art may use a wide variety of components within the principles of the invention. For example, the stored audible sounds may be digitally synthesized and stored sounds released under microprocessor control in response to various other means for detecting motion that may be provided through photoelectric or other transducers.

It is evident that those skilled in the art may now make numerous uses and modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Apparatus for encouraging walking comprising:

vehicle means for supporting a person and assisting said person in walking, said vehicle means having push bar means for engagement by said person for receiving a force from said person causing movement of said vehicle means and also having a source of a stored audible message encouraging said person hearing the message to walk and move the vehicle means, transducing means for reproducing the stored audible message, means responsive to movement of said vehicle means for providing a movement signal, and means responsive to said movement signal for providing said stored audible message to said transducing means only while said vehicle means is moving.

2. Apparatus in accordance with claim 1 wherein said means responsive to movement is tachogenerator means responsive to rotation of a wheel on said vehicle means for producing said movement signal.

3. Apparatus in accordance with claim 2 and further comprising relay means responsive to said movement signal for being operated to cause the stored audible message signal to be reproduced by said transducing means.

4. Apparatus in accordance with claim 3 wherein said source of a stored audible message is a tape recorder.

* * * * *

UNITED STATES PATENT AND TRADEMARK OFFICE

CERTIFICATE OF CORRECTION

PATENT NO. : 4,982,951

DATED : January 8, 1991

INVENTOR(S) : Elyena Foster et al.

It is certified that error appears in the above-identified patent and that said Letters Patent is hereby corrected as shown below:

Column 2, line 48, "tacogenerator" should read --tachogenerator--.

Column 4, line 24, "tachogenerator" should read --tachogenerating--.

Signed and Sealed this

Twenty-seventh Day of April, 1993

*Attest:*

MICHAEL K. KIRK

*Attesting Officer*

*Acting Commissioner of Patents and Trademarks*